US008070507B1

(12) United States Patent
Liang

(10) Patent No.: US 8,070,507 B1
(45) Date of Patent: Dec. 6, 2011

(54) CONNECTOR ASSEMBLY

(75) Inventor: An-Gang Liang, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 12/978,528

(22) Filed: Dec. 24, 2010

(30) Foreign Application Priority Data

Dec. 6, 2010 (CN) ..... 2010 1 0574881

(51) Int. Cl.
*H01R 13/56* (2006.01)

(52) U.S. Cl. ..... 439/446

(58) Field of Classification Search ..... 439/446, 439/445, 471–474
See application file for complete search history.

(56) References Cited

U.S. PATENT DOCUMENTS 6,036,529 A * 3/2000 Brown et al. ..... 439/446

* cited by examiner

*Primary Examiner* — Felix O Figueroa
(74) *Attorney, Agent, or Firm* — Altis Law Group, Inc.

(57) ABSTRACT

A connector assembly includes a connector connected to a number of cables, and a cable management member pivotably attached to the connector. The cable management member includes a pressing plate for binding the cables.

3 Claims, 3 Drawing Sheets

CONNECTOR ASSEMBLY

BACKGROUND

1. Technical Field

The present disclosure relates to a connector assembly.

2. Description of Related Art

Connectors for a computer or a server are connected to cables and electrically connected to other components. However, the cables adjacent to the connectors usually need to be pressed down or constrained in order to assemble covers or other structures to enclose the components, which is inconvenient.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

The present disclosure, including the accompanying drawings, is illustrated by way of examples and not by way of limitation. It should be noted that references to "an" or "one" embodiment in this disclosure are not necessarily to the same embodiment, and such references mean at least one.

Figure 1:
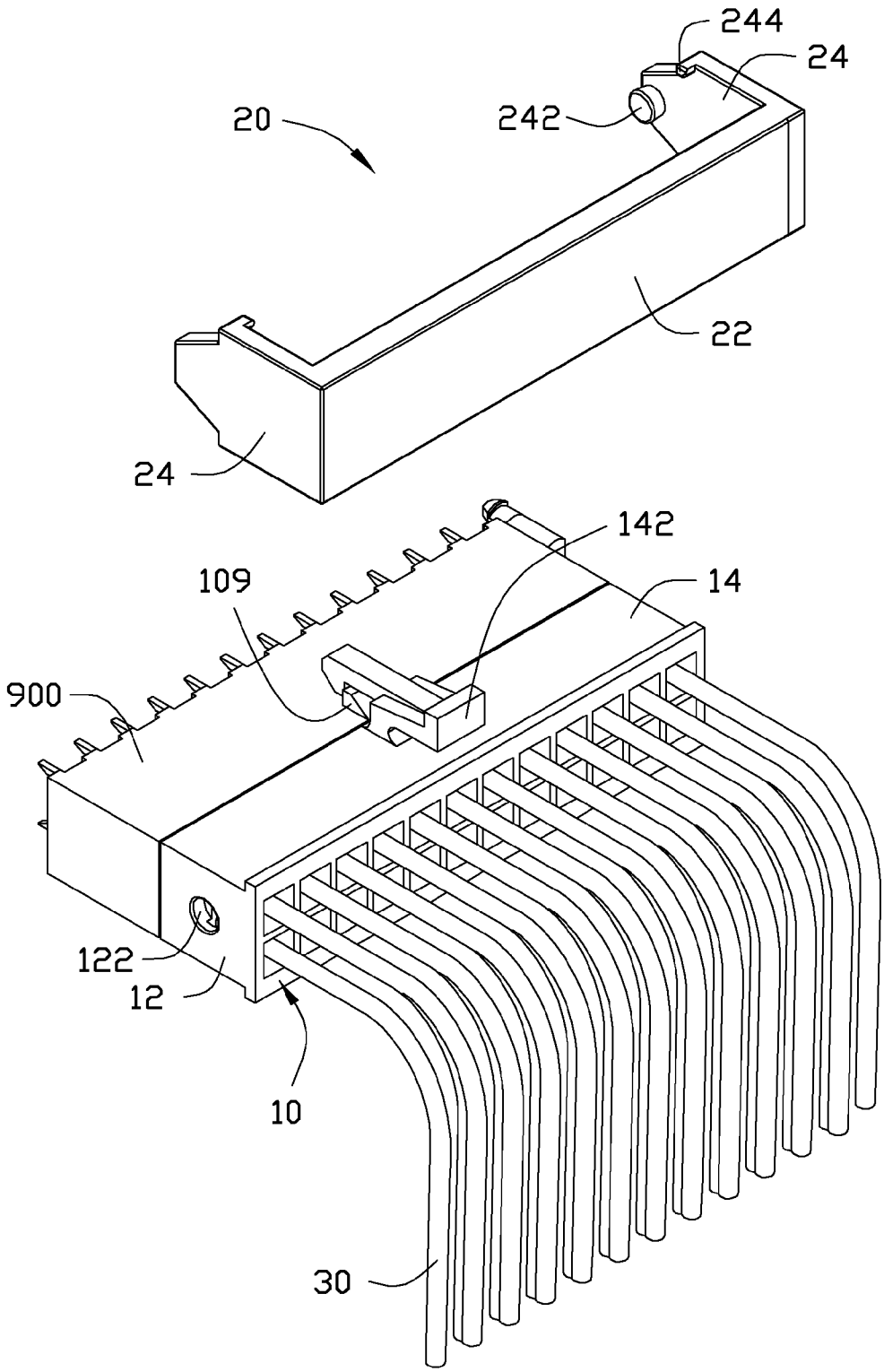
FIG. 1 is an exploded, isometric view of an exemplary embodiment of a connector assembly, together with a socket.

Referring to FIG. 1, an exemplary embodiment of a connector assembly includes a connector 10, and a cable management member 20. The connector 10 is designed to be plugged into a socket 900 fixed to a circuit board (not shown in pictures).

A protrusion 109 is formed on one side of the socket 900.

The connector 10 is electrically connected to a plurality of cables 30. The connector 10 includes two end surfaces 12 parallel to each other, and two side surfaces 14 parallel to each other and substantially perpendicularly connected between the end surfaces 12. A pivot hole 122 is defined in each end surface 12 of the connector 10. A hook 142 is formed on one of the side surfaces 14 of the connector 10. When the connector 10 is plugged in the socket 900, the hook 142 of the connector 10 is locked to the protrusion 109 of the socket 900.

The cable management member 20 is substantially U-shaped and includes a pressing plate 22 and two tapered pivoting plates 24 extending substantially perpendicularly from opposite ends of the pressing plate 22. A post 242 extends from each pivoting plate 24 toward the other pivoting plate 24. A limiting tab 244 extends from an edge of each pivoting plate 24 adjacent to the corresponding post 242, toward the other pivoting plate 24.

Figure 2:
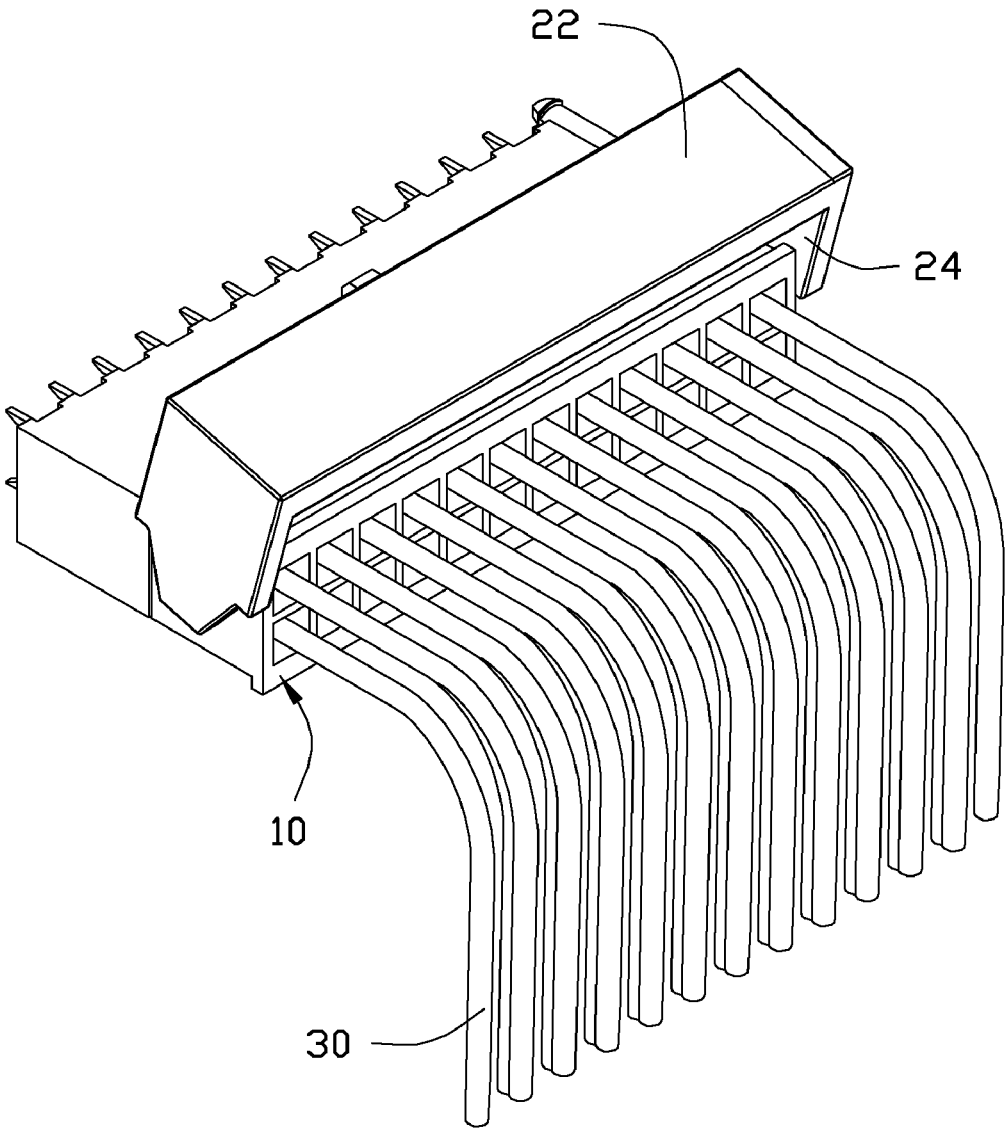
FIG. 2 is an assembled, isometric view of FIG. 1.

Referring to FIG. 2, in assembly, the pivoting plates 24 of the cable management member 20 are deformed to splay, to allow the posts 242 of the cable management member 20 engage in the corresponding pivot holes 122 of the connector 10. Thus, the cable management member 20 is pivotably attached to the connector 10.

Figure 3:
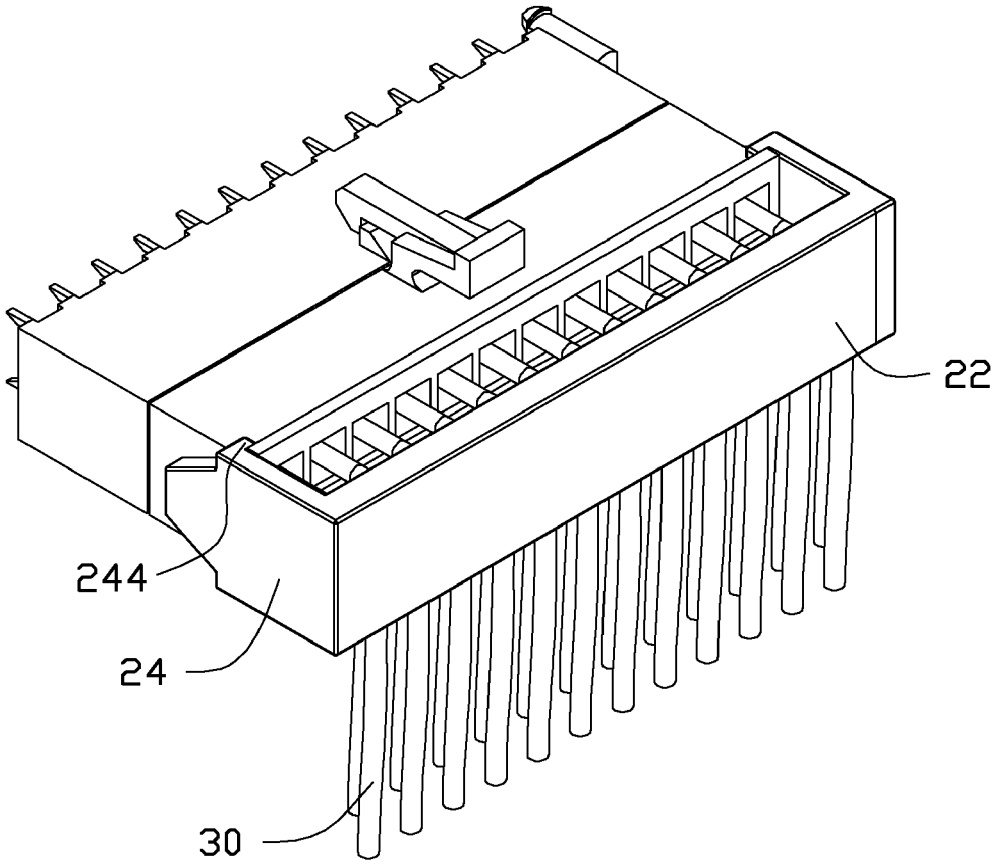
FIG. 3 is similar to FIG. 2, but showing a state of use.

Referring to FIG. 3, in use, the cable management member 20 is pivoted to make the pressing plate 22 of the cable management member 20 press and bind the cables 30. The limiting tabs 244 of the cable management member 20 block one of the side surfaces 14 of the connector 10 to limit the cable management member 20, from further rotating to damage the cables 30.

It is to be understood, however, that even though numerous characteristics and advantages of the embodiments have been set forth in the foregoing description, together with details of the structure and function of the embodiments, the present disclosure is illustrative only, and changes may be made in details, especially in matters of shape, size, and arrangement of parts within the principles of the embodiments to the full extent indicated by the broad general meaning of the terms in which the appended claims are expressed.

What is claimed is:

1. A connector assembly comprising:

a connector connected to a plurality of cables, wherein the connector comprises two end surfaces parallel to each other, and two side surfaces parallel to each other and connected between the end surfaces, and a pivot hole is defined in each of the end surfaces of the connector; and a cable management member pivotably attached to the connector, the cable management member comprising a pressing plate for binding the plurality of cables, and two pivoting plates extending substantially perpendicularly from opposite ends of the pressing plate, wherein a post extends from each of the pivoting plates toward the other pivoting plate to engage in one of the two pivot holes of the connector, and a limiting tab extends from each of the pivoting plates to abut one of the side surfaces of the connector when the cable management member binds the plurality of cables.

2. The connector assembly of claim 1, wherein a hook is formed on one of the side surfaces of the connector to engage with a socket that the connector is connected to.

3. A connector assembly comprising:

a socket with a protrusion formed on one side thereof;

a connector plugged into the socket and connected to a plurality of cables, wherein the connector comprises two end surfaces parallel to each other, and two side surfaces parallel to each other and connected between the end surfaces, a pivot hole is defined in each of the end surfaces of the connector, and a hook is formed on one of the side surfaces of the connector and locked to the protrusion of the socket; and a cable management member comprising a pressing plate for binding the plurality of cables, and two pivoting plates extending substantially perpendicularly from opposite ends of the pressing plate, wherein the pressing plate and the pivoting plates together define a U shape, a post extends from each of the pivoting plates toward the other pivoting plate to engage in one of the two pivot holes of the connector, and a limiting tab extends from each of the pivoting plates to abut one of the side surfaces of the connector when the cable management member binds the plurality of cables.

* * * * *